US008519635B2

(12) United States Patent
Lin

(10) Patent No.: US 8,519,635 B2
(45) Date of Patent: Aug. 27, 2013

(54) LIGHT-EMITTING DEVICE

(75) Inventor: Chung-Jyh Lin, YongKang (TW)

(73) Assignee: Aussmak Optoelectronics Corp., YongKang, Tainan County (TW)

( * ) Notice: Subject to any disclaimer, the term of this patent is extended or adjusted under 35 U.S.C. 154(b) by 360 days.

(21) Appl. No.: 12/957,375

(22) Filed: Nov. 30, 2010

(65) Prior Publication Data

US 2011/0127919 A1 Jun. 2, 2011

(30) Foreign Application Priority Data

Dec. 2, 2009 (TW) ..... 98141227 A

(51) Int. Cl.
*H05B 37/02* (2006.01)

(52) U.S. Cl.
USPC ..... 315/291; 315/307; 315/312; 315/185 R; 315/192; 315/193; 315/122

(58) Field of Classification Search
USPC ..... 315/291, 185, 186, 185 R, 122, 323, 315/312, 192, 193, 307, 360
See application file for complete search history.

(56) References Cited

U.S. PATENT DOCUMENTS

| | | | | |
|---|---|---|---|---|
| 8,174,212 | B2 * | 5/2012 | Tziony et al. | 315/309 |
| 8,188,687 | B2 * | 5/2012 | Lee et al. | 315/323 |
| 8,299,724 | B2 * | 10/2012 | Huynh | 315/291 |
| 2009/0230883 | A1 * | 9/2009 | Haug | 315/297 |
| 2011/0068702 | A1 * | 3/2011 | van de Ven et al. | 315/186 |
| 2012/0104952 | A1 * | 5/2012 | Chen | 315/122 |

* cited by examiner

*Primary Examiner* — Haiss Philogene
(74) *Attorney, Agent, or Firm* — Cheng-Ju Chiang

(57) ABSTRACT

A light-emitting device, electrically connected to an external variable voltage source, includes a plurality of light-emitting modules sequentially electrically connected in series and electrically connected to the external variable voltage source. Each light-emitting module has at least one light-emitting unit, a first connection terminal and a second connection terminal. At least one of the light-emitting modules has a control unit and a bypass unit electrically connected to the light-emitting unit. The second connection terminal of the light-emitting module having the bypass unit and the control unit is electrically connected to the first connection terminal of the other light-emitting module and serves as a detection terminal. The control unit detects a voltage of the detection terminal and accordingly controls the bypass unit to adjust a current flowing through the light-emitting unit.

16 Claims, 6 Drawing Sheets

LIGHT-EMITTING DEVICE

CROSS REFERENCE TO RELATED APPLICATIONS

This Non-provisional application claims priority under 35 U.S.C. §119(a) on Patent Application No(s). 098141227 filed in Taiwan, Republic of China on Dec. 2, 2009, the entire contents of which are hereby incorporated by reference.

BACKGROUND OF THE INVENTION

1. Field of Invention

The present invention relates to a light-emitting device.

2. Related Art

LED (light-emitting diode) is a semiconductor component and is used as the light source of indicator and outdoor media board many years ago. Compared with the traditional light source, the LED has the advantages of good efficiency, long lifetime, and strong structure, so that it has been widely used in various kinds of electronic products.

The control method for the light-emitting apparatus that uses the LED as the light source commonly includes a constant voltage control and a constant current control. As shown in FIG. 1A, a conventional light-emitting apparatus 1A, which has the constant voltage control, includes a light-emitting module 11, a capacitor 12, a plurality of resistors 13 and a constant voltage source 14. In order to ensure the signal inputted into the LED to be a constant voltage signal, the capacitor with large capacitance or complex rectifying circuit is usually configured so as to achieve the desired constant voltage. Thus, the manufacturing cost is increased.

Although the constant voltage control has the advantage of simpler layout design, it cannot provide a stable current for the light-emitting module. Since the LED emits light due to the combination of the electrons and holes to release the excess energy, the change of the applied current can induce a sufficient influence to the lighting property of the LED. In other words, the constant voltage control cannot precisely control the lighting property of the LED.

As shown in FIG. 1B, a conventional light-emitting apparatus 1B, which has the constant current control, includes a light-emitting module 11, a capacitor 12, a plurality of resistors 13, a constant current source 15, and a detecting unit 16. In this case, the constant current control can provide a more stable current to the LED. However, in practice, the forward voltages of the LEDs may have difference from each other because of the factors of the manufacturing process and operation temperature. In order to eliminate this difference, the resistor 13 must be used as the current limiter to absorb the power difference caused by the electrical variation so as to stable the current. Thus, the additional power loss may occur.

In the light-emitting apparatus of either the constant voltage control or the constant current control, a power supply unit for providing a stable power source or an element for stabling the voltage or current is necessary. Therefore, it is an important subject of the invention to provide a light-emitting device capable of automatically adjusting the number of light-emitting units of the light-emitting device to achieve the variable voltage driving in response to the fluctuation of an external power.

SUMMARY OF THE INVENTION

In view of the foregoing subject, an objective of the invention to provide a light-emitting device capable of automatically adjusting the number of light-emitting units of the light-emitting device to achieve the variable voltage driving in response to the fluctuation of an external power.

To achieve the above objective, the present invention discloses a light-emitting device electrically connected to an external variable voltage source and including a plurality of light-emitting modules. The light-emitting modules sequentially electrically connected in series and electrically connected to the external variable voltage source. Each light-emitting module has at least one light-emitting unit, a first connection terminal and a second connection terminal. At least one of the light-emitting modules has a control unit and a bypass unit electrically connected to the light-emitting unit. The second connection terminal of the light-emitting module having the bypass unit and the control unit is electrically connected to the first connection terminal of the other light-emitting module and serves as a detection terminal. The control unit detects a voltage of the detection terminal and accordingly controls the bypass unit to adjust a current flowing through the light-emitting unit.

In one embodiment of the invention, the control unit controls the bypass unit according to a potential difference between the voltage of the detection terminal and at least one reference voltage.

In one embodiment of the invention, the voltage of the detection terminal is affected by a crossover voltage generated when the light-emitting unit of the other light-emitting module is turned on.

As mentioned above, the light-emitting device according to the invention utilizes the control unit to detect the voltage of the detection terminal of the light-emitting module in response to the variations of the forward voltages of the other light-emitting modules, and utilizes the bypass unit to automatically adjust the number of the light-emitting units of the light-emitting device and to adjust the current flowing through the light-emitting unit of the light-emitting module. Thus, the variable voltage driving may be implemented.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
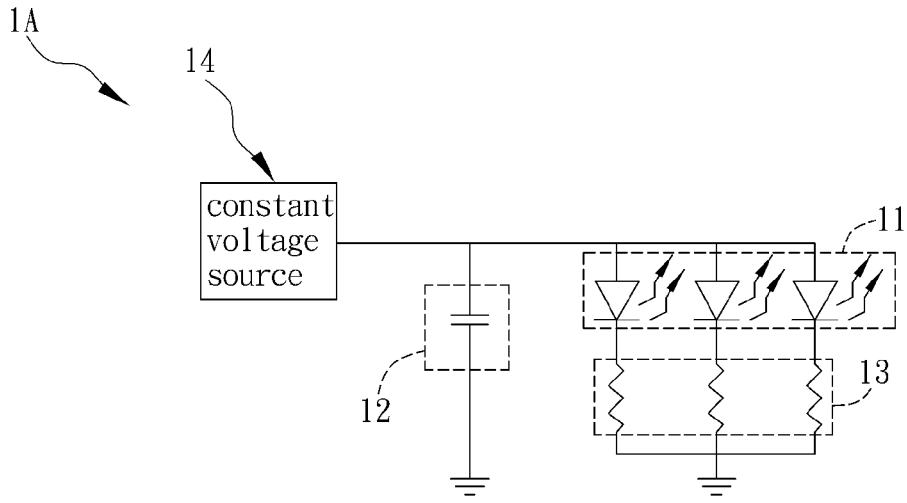
FIG. 1A(Prior Art)
FIG. 1A is a schematic diagram of a conventional light-emitting apparatus with the constant voltage control.
Figure 1B:
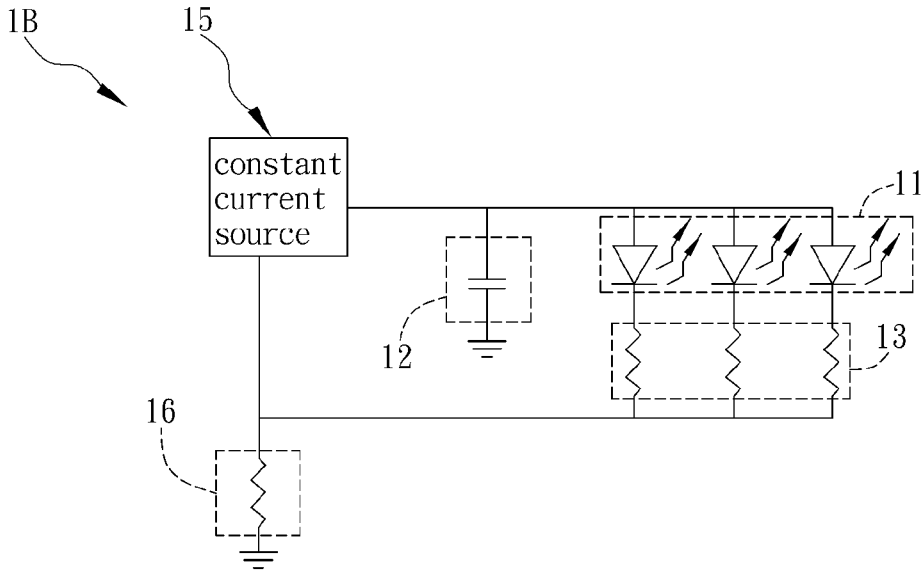
FIG. 1B(Prior Art)
FIG. 1B is a schematic diagram of a conventional light-emitting apparatus with the constant current control.
Figure 2:
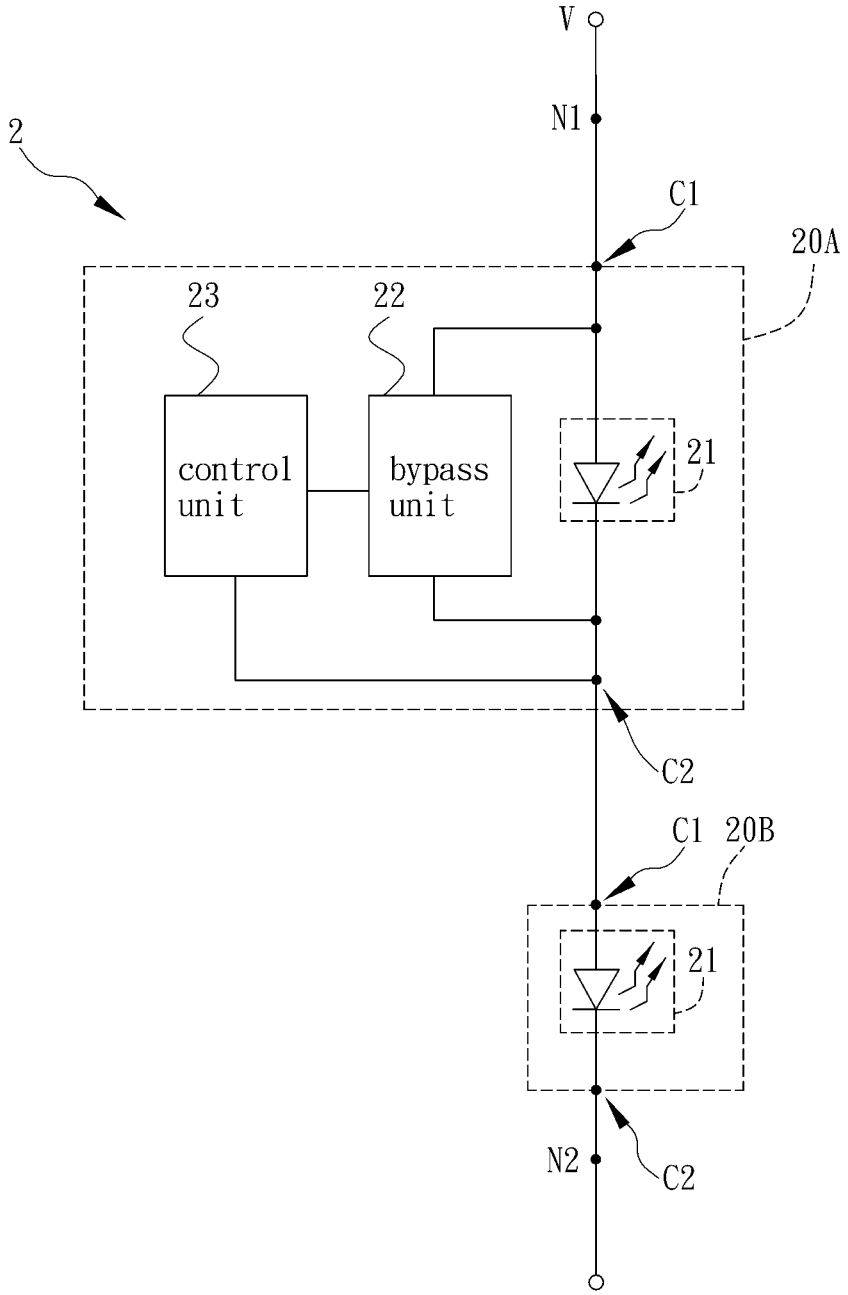
FIG. 2 is a schematic illustration showing a light-emitting device according to a preferred embodiment of the invention.

FIG. 2 is a schematic illustration showing a light-emitting device according to a preferred embodiment of the invention. Referring to FIG. 2, a light-emitting device 2 electrically connected to an external variable voltage source V includes two light-emitting modules 20A and 20B. In this embodiment, the light-emitting modules 20A and 20B are sequentially electrically connected in series between two nodes N1 and N2, which are electrically connected to the external variable voltage source V.

In practice, the external variable voltage source V may be an AC voltage or a DC voltage, and is a non-constant voltage having a level periodically or randomly varying with time. The AC voltage may be the well known mains, which means the AC power ranging from 90V to 250V, and may also be an AC power outputted from a power converter. In addition, the DC voltage includes the voltage generated by a battery or a cell or generated from an AC voltage through a rectifier circuit. The output voltage of the battery or the cell may fluctuate with the increase of the using time. In addition, the DC voltage generated by the rectifier circuit still has ripples. Thus, the DC voltage level still varies with time in the practical applications.

Each of the light-emitting modules 20A and 20B has a light-emitting unit 21, a first connection terminal C1 and a second connection terminal C2. In this embodiment, the light-emitting module 20A further has a bypass unit 22 and a control unit 23, wherein the bypass unit 22 is electrically connected in parallel with the light-emitting unit 21. The light-emitting module 20A having the bypass unit 22 and the control unit 23 is electrically connected to the first connection terminal C1 of the other light-emitting module 20B through the second connection terminal C2. The interconnection portion between the second connection terminal C2 of the light-emitting module 20A and the first connection terminal C1 of the light-emitting module 20B serves as a detection terminal. In practice, the first connection terminal C1 is a connection terminal through which the current flows into the light-emitting module, and the second connection terminal C2 is a connection terminal through which the current flows out of the light-emitting module.

The control unit 23 is electrically connected to the detection terminal and detects the voltage variation thereof to control the bypass unit 22, and thus to adjust the current flowing through the light-emitting unit 21 connected in parallel with the bypass unit 22. In other words, the light-emitting module 20A having the bypass unit 22 and the control unit 23 detects the voltage of the detection terminal to control the bypass unit 22 to turn on and off, and to control the current flowing through the light-emitting unit 21. In this embodiment, the detection terminal is the second connection terminal C2 of the light-emitting module 20A having the bypass unit 22 and the control unit 23.

Figure 3A:
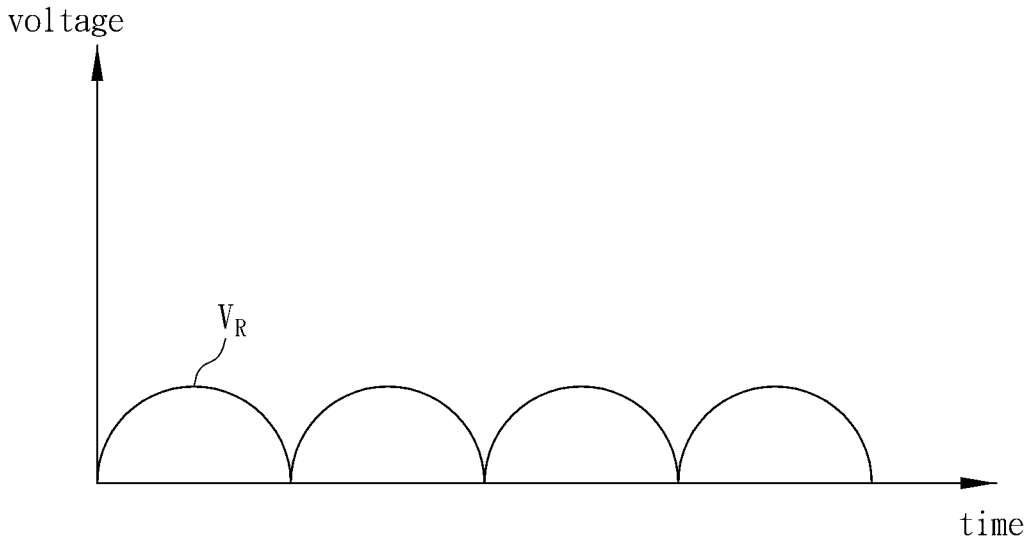
FIG. 3A is a schematic illustration showing the output of a rectified voltage source of the invention.

The light-emitting device 3 will be further described with reference to FIGS. 3A and 3B. To make the following description to be more comprehensive, the light-emitting device 3 of the present embodiment includes, for example but not limited to, three light-emitting modules.

In this embodiment, the external variable voltage source V is an AC voltage source electrically connected to a rectifier REC. The rectifier REC rectifies the AC voltage outputted from the external variable voltage source V, and provides a rectified voltage $V_R$ to a light-emitting device 3. FIG. 3A is a schematic illustration showing the rectified voltage $V_R$ generated by the rectifier REC.

Figure 3B:
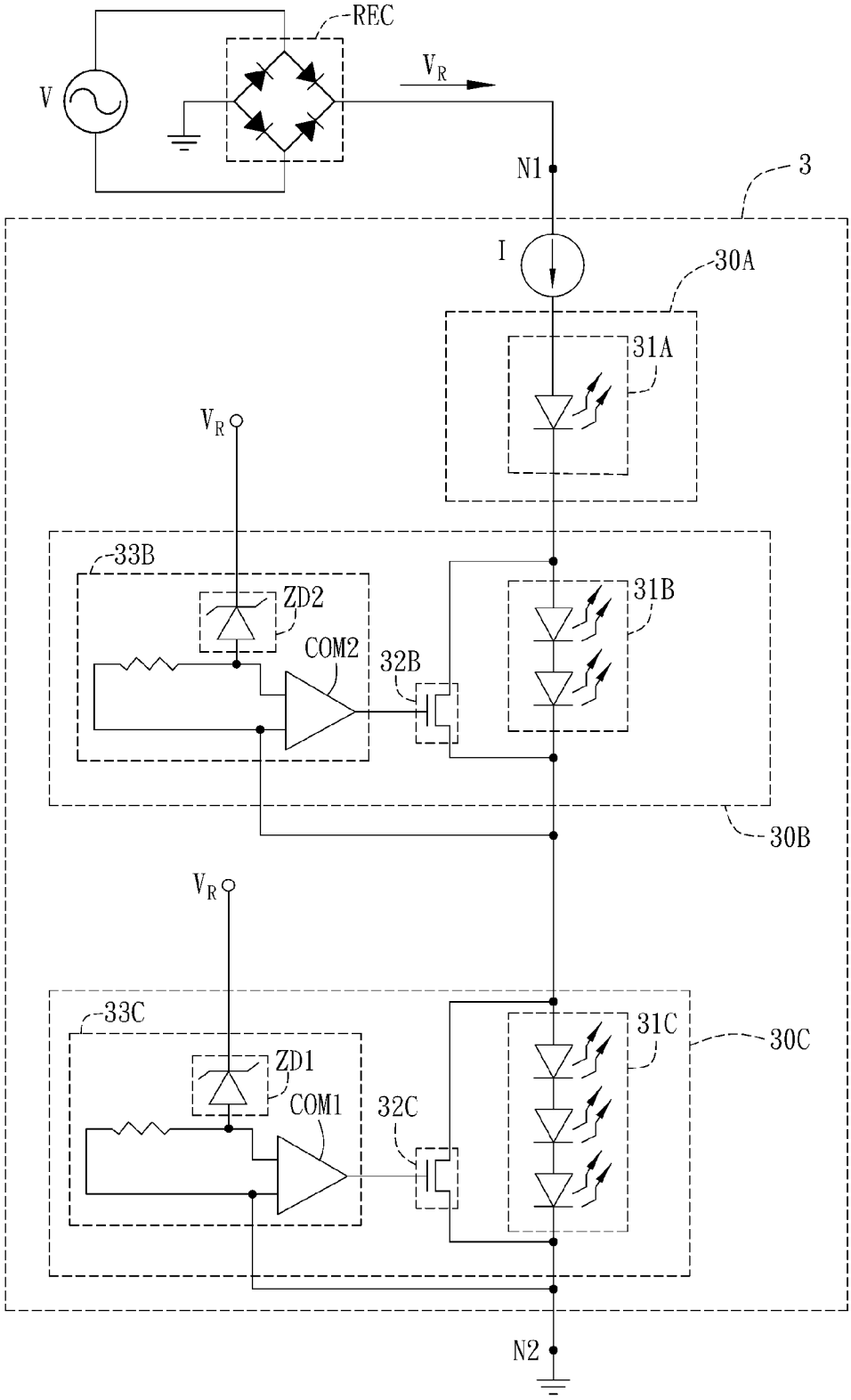
FIG. 3B is a schematic illustration showing another light-emitting device according to the preferred embodiment of the invention.

As shown in FIG. 3B, the light-emitting device 3 includes three light-emitting modules 30A to 30C sequentially connected in series between the node N1 and the node N2. The node N1 is electrically connected to the output terminal of the rectifier REC to receive the rectified voltage $V_R$, while the node N2 is electrically connected to a ground. In addition, the light-emitting module 30A in this embodiment is electrically connected to a current source I, and the light-emitting units 31A to 31C of the light-emitting modules 30A to 30C respectively have one, two and three light-emitting diodes (LEDs).

Herein, it is to be noted that the light-emitting units 31A to 31C respectively have one, two and three LEDs in this example embodiment, and the LEDs of the light-emitting units 31B and 31C are connected in series. However, the other number of LEDs may be used to operate according to the actual requirement, and the LEDs of the light-emitting units may be connected in series or in parallel.

The light-emitting module 30B/30C has one bypass unit 32B/32C and one control unit 33B/33C. The bypass unit 32B is connected in parallel with the light-emitting unit 31B, while the bypass unit 32C is connected in parallel with the light-emitting unit 31C. In practice, the bypass unit includes at least one transistor switch. In this embodiment, the bypass unit 32B/32C includes one field effect transistor (FET).

The control unit 33B/33C is electrically connected to the bypass unit 32B/32C. In this embodiment, the control unit 33C has a comparison circuit COM1. Two comparison input terminals of the comparison circuit COM1 are respectively electrically connected to the rectified voltage $V_R$ and the connection terminal between the light-emitting module 31C and the second node N2, and a first Zener diode ZD1 is disposed on the electrical connection portion between the comparison circuit COM1 and the rectified voltage $V_R$ to provide a reference voltage. The specifications of the first Zener diode ZD1 may be selected according to the actual application and thus can be designed to be different. For example, the specifications of the first Zener diode ZD1 may be selected based on a forward voltage of each light-emitting unit. In this embodiment, the breakdown voltage value of the first Zener diode ZD1 is equal to or slightly greater than the sum of the forward voltages of the light-emitting units 31A and 31C.

In this embodiment, the control unit 33B has a comparison circuit COM2, which has two comparison input terminals and one comparison output terminal. The comparison input terminals are electrically connected to the rectified voltage $V_R$ and the detection terminal between the light-emitting modules 30B and 30C, and the comparison output terminal is electrically connected to the bypass unit 32B. The control unit 33B compares the reference voltage from the rectified voltage $V_R$ with the potential of the detection terminal, and controls the bypass unit 32B according to the potential difference between the rectified voltage $V_R$ and the voltage of the detection terminal. In practice, the detection terminal is the contact point wherein the light-emitting unit 31B of the light-emitting module 30B is serially connected to the light-emitting unit 31C of the light-emitting module 30C.

In addition, a second Zener diode ZD2 is disposed on an electrical connection portion between the comparison circuit COM2 and the rectified voltage $V_R$ in this embodiment. In this embodiment, a breakdown voltage value of the second Zener diode ZD2 is equal to or slightly greater than the sum of the forward voltages of the light-emitting units 31A and 31B. In this embodiment, the breakdown voltage value of the second Zener diode ZD2 is smaller than the breakdown voltage value of the first Zener diode ZD1. In addition, the comparison circuit COM1/COM2 may be composed of transistor switches in practice.

The operation of the light-emitting device 3 will be described hereinafter with reference to FIG. 3A in view of FIG. 3B. In the actual operation, the light-emitting device 3 receives the rectified voltage $V_R$ outputted from the rectifier REC. When the rise of the voltage level of the rectified voltage $V_R$ exceeds the forward voltage of the light-emitting unit 31A, the light-emitting unit 31A is lighted up. At this time, the voltage value of the rectified voltage $V_R$ is still smaller than the breakdown voltage value of the first Zener diode ZD1. Thus, the absolute value of the voltage difference between the potential of the node N2 and the rectified voltage $V_R$ is smaller than a first predetermined value, and the control unit 33C controls the bypass unit 32C to be short-circuited, so the light-emitting unit 31C is not lighted up. The first predetermined value relates to the breakdown voltage of the selected first Zener diode ZD1; in this embodiment, the first predetermined value is the breakdown voltage value of the first Zener diode ZD1. In addition, because the bypass unit 32C is short-circuited, the voltage of the detection terminal detected by the control unit 33B is equal to the potential of the node N2. At this time, the absolute value of the voltage difference between the voltage of the detection terminal and the rectified voltage $V_R$ is similarly smaller than a second predetermined value. The second predetermined value is the breakdown voltage value of the second Zener diode ZD2. So, the light-emitting unit 31B is also not lighted up.

When the voltage level of the rectified voltage $V_R$ is continuously risen to exceed the breakdown voltage of the second Zener diode ZD2, the absolute value of the voltage difference between the potential of the detection terminal and the rectified voltage $V_R$ is greater than the second predetermined value, and the control unit 33B controls the bypass unit 2B to be open-circuited so that the light-emitting unit 31B is lighted up. Meanwhile, because the absolute value of the voltage difference between the potential of the node N2 and the rectified voltage $V_R$ is still smaller than the first predetermined value, the light-emitting unit 31C is still not lighted up.

When the voltage level of the rectified voltage $V_R$ is continuously risen to exceed the breakdown voltage of the first Zener diode ZD1 of the control unit 33C, the absolute value of the voltage difference between the potential of the node N2 and the rectified voltage $V_R$ is greater than the first predetermined value, and the control unit 33C controls the bypass unit 32C to be open-circuited so that the light-emitting unit 31C is lighted up. Meanwhile, the voltage of the detection terminal is affected by the lighting-up of the light-emitting unit 31C and is increased to become the forward voltage of the light-emitting unit 31C. Thus, the voltage difference between the voltage of the detection terminal and the rectified voltage $V_R$ becomes lower than the breakdown voltage of the second Zener diode ZD2 of the control unit 33B. That is, the absolute value of the voltage difference between the voltage of the detection terminal and the rectified voltage $V_R$ is smaller than the second predetermined value, and the control unit 33B controls the bypass unit 32B to change from the open-circuited state to the short-circuited state, so the light-emitting unit 31B is changed from the lighted state to the unlighted state.

Next, when the voltage level of the rectified voltage $V_R$ is continuously risen such that the voltage difference between the voltage of the detection terminal and the rectified voltage $V_R$ exceeds the breakdown voltage of the second Zener diode ZD2 of the control unit 33B, the absolute value of the voltage difference between the voltage of the detection terminal and the rectified voltage $V_R$ is greater than the second predetermined value, the control unit 33B controls the bypass unit 32B to be open-circuited, and the light-emitting unit 31B is again lighted up.

According to the above-mentioned hardware structure, the control unit of the light-emitting module detects the potential of the interconnection terminal between the light-emitting module and the other light-emitting module. More specifically, the control unit detects the contact point between the light-emitting units of the neighboring connected light-emitting modules in response to the variation of the forward voltage of the downstream light-emitting modules, and adjusts, through the bypass unit, the current flowing through the light-emitting unit connected in parallel with the bypass unit. In other words, the voltage of the detection terminal detected by the control unit is affected by the crossover voltage generated when the light-emitting units of the downstream light-emitting modules are bypassed or turned on. That is, the voltage of the detection terminal represents the variation of the total crossover voltage of all the light-emitting modules electrically connected between the detection terminal and the ground. The variation of the crossover voltage further includes the variation of the crossover voltage generated when the light-emitting unit is affected by the temperature, current, degradation and the like. Thus, the voltage of the detection terminal is a floating voltage. Therefore, in this embodiment, the control unit can further correctly and immediately respond with whether the present voltage can sufficiently drive the light-emitting unit controlled thereby.

Figure 4:
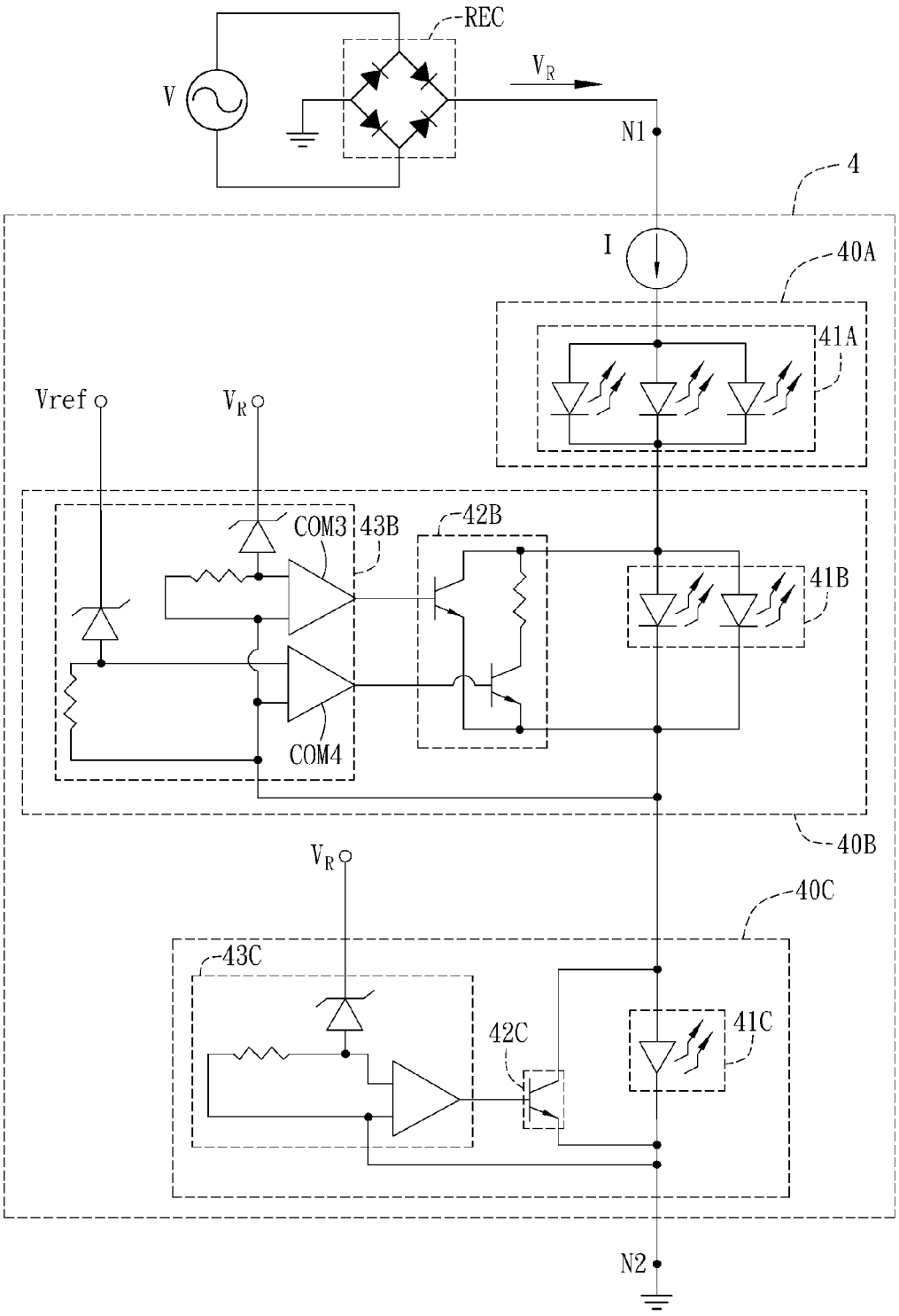
FIGS. 4 and 5 are schematic illustrations showing modified aspects of the light-emitting device according to the preferred embodiment of the invention.

FIG. 4 is a schematic illustration showing a modified aspect of the light-emitting device according to the preferred embodiment of the invention. As shown in FIG. 4, the differences between a light-emitting device 4 and the light-emitting device 3 reside in that the light-emitting units 41A to 41C of the light-emitting modules 40A to 40C respectively have three, two and one LED, that the LEDs of the light-emitting units 41B and 41C are connected in parallel, that the bypass unit 42B includes two transistor switches and one resistor, and that the control unit 43B has two comparison circuits. In addition, the transistor switches contained in the bypass units 42B and 42C of this embodiment are bipolar transistors (BJTs).

In this embodiment, two transistor switches of the bypass unit 42B are connected in parallel with the light-emitting unit 41B. The two comparison input terminals of the comparison circuit COM3 of the control unit 43B are respectively electrically connected to the rectifier REC and the interconnected detection terminal between the light-emitting modules 40B and 40C, and the comparison output terminal is electrically connected to a transistor switch of the bypass unit 42B. The two comparison input terminals of the comparison circuit COM4 of the control unit 43B are respectively electrically connected to a reference voltage $V_{ref}$ and the interconnected detection terminal between the light-emitting modules 40B and 40C, and the comparison output terminal is electrically connected to the other transistor switch of the bypass unit 42B. In practice, the reference voltage $V_{ref}$ may originate from a controller, a signal generator or any other power supply unit, and the potential of the reference voltage $V_{ref}$ may have different configurations according to the actual requirement of the product.

In this embodiment, the two transistor switches of the bypass unit 42B are respectively controlled by the comparison circuits COM3 and COM4, and the reference potentials, received by the comparison circuits COM3 and COM4 and to be compared with the voltage of the detection terminal, are not the same. So, the control unit 43B can control the bypass unit 42B to be short-circuited, open-circuited or partially open-circuited, such that the light-emitting unit 41B does not emit light, completely emits light or partially emits light. In other words, the diffluent effect can be achieved according to the structure of this embodiment so as to control the brightness of the light-emitting unit 41B.

In addition, it is to be noted that when the light-emitting device has more light-emitting modules, the order of lighting the light-emitting modules can be changed by selecting different specifications of Zener diodes and adjusting the voltage value of the reference voltage.

Figure 5:
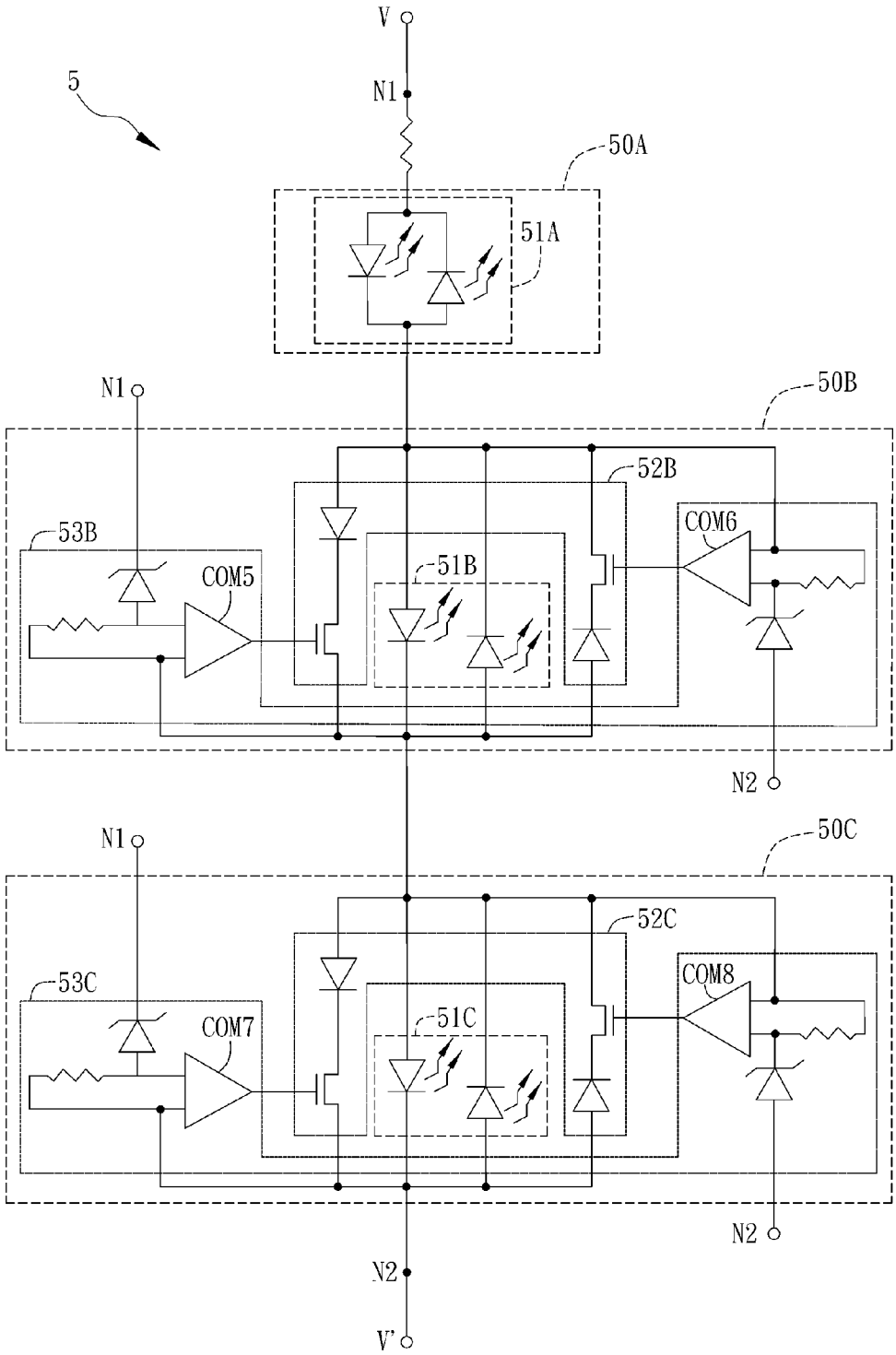

FIG. 5 is a schematic illustration showing another modified aspect of the light-emitting device according to the preferred embodiment of the invention. As shown in FIG. 5, each of the light-emitting modules 50A to 50C has two oppositely parallelly connected LEDs, and the light-emitting modules 50A to 50C are serially connected between the node N1 and the node N2.

In this embodiment, the external variable voltage sources V and V' are AC voltages and respectively electrically connected to the node N1 and the node N2. The external variable voltage source V represents the power in the positive half cycle, and is inputted to the light-emitting device through the node N1. In addition, the external variable voltage source V' represents the power in the negative half cycle, and is inputted to the light-emitting device through the node N2.

The differences between a light-emitting device 5 and the light-emitting device 3 reside in that the bypass units 52B and 52C respectively include two transistor switches, while the control units 53B and 53C respectively have two comparison circuits.

The two comparison input terminals of the comparison circuit COM5 of the control unit 53B are respectively electrically connected to the node N1 and the interconnected detection terminal between the light-emitting modules 50B and 50C, and the comparison output terminal is electrically connected to a transistor switch of the bypass unit 52B. The two comparison input terminals of the comparison circuit COME of the control unit 53B are respectively electrically connected to a node N2 and the interconnected detection terminal between the light-emitting modules 50A and 50B, and the comparison output terminal is electrically connected to the other transistor switch of the bypass unit 52B.

In addition, the two comparison input terminals of the comparison circuit COM7 of the control unit 53C are respectively electrically connected to the node N1 and the connection terminal between the light-emitting module 50C and the node N2, and the comparison output terminal is electrically connected to a transistor switch of the bypass unit 52C. The two comparison input terminals of the comparison circuit COM8 of the control unit 53C are respectively electrically connected to the node N2 and the interconnected detection terminal between the light-emitting modules 50C and 50B, and the comparison output terminal is electrically connected to the other transistor switch of the bypass unit 52C.

In this embodiment, when the external variable voltage source V having the voltage level being the positive half cycle is inputted to the light-emitting device 5, the light-emitting modules 50A to 50C of the light-emitting device 5 are sequentially lighted up in the order from the light-emitting module 50A to the light-emitting module 50C and then to the light-emitting module 50B, and are then sequentially extinguished in the reverse order. When the external variable voltage source V' having the voltage level being the negative half cycle is inputted to the light-emitting device 5, the light-emitting modules 50A to 50C of the light-emitting device 5 are sequentially lighted up in the order from the light-emitting module 50A to the light-emitting module 50B and then to the light-emitting module 50C, and are then sequentially extinguished in the reverse order.

In other words, in the light-emitting modules having the same control unit and bypass unit in this embodiment, the light-emitting module nearer to the output terminal of the external variable voltage source V/V' is lighted up prior to the other light-emitting modules during the rising of the external variable voltage source V/V'.

In addition, it is to be noted that the invention does not intend to limit the number of LEDS contained in each light-emitting unit and the connections of the LEDs. In addition, the light-emitting device of the invention may be applied to a mobile communication field, an illumination field of a traffic transportation tool and an ordinary illumination application field.

To sum up, the light-emitting device according to the invention utilizes the control unit to detect the voltage of the detection terminal of the light-emitting module in response to the variations of the forward voltages of the other light-emitting modules, and utilizes the bypass unit to automatically adjust the number of the light-emitting units of the light-emitting device and to adjust the current flowing through the light-emitting unit of the light-emitting module. Thus, the variable power driving may be implemented.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A light-emitting device electrically connected to an external variable voltage source, the light-emitting device comprising:

a plurality of light-emitting modules sequentially electrically connected in series and electrically connected to the external variable voltage source, wherein:

each of the light-emitting modules has at least one light-emitting unit, a first connection terminal and a second connection terminal;

at least one of the light-emitting modules has a bypass unit and a control unit;

the bypass unit is electrically connected to the light-emitting unit;

the second connection terminal of the light-emitting module having the bypass unit and the control unit is electrically connected to the first connection terminal of the other light-emitting module and serves as a detection terminal; and the control unit detects a voltage of the detection terminal and accordingly controls the bypass unit and adjusts a current flowing through the light-emitting unit.

2. The light-emitting device according to claim 1, wherein the light-emitting modules are sequentially electrically connected in series between a first node and a second node.

3. The light-emitting device according to claim 2, wherein the first node and the second node are electrically connected with the external variable voltage source.

4. The light-emitting device according to claim 3, wherein the first node and the second node sequentially serve as current output terminals with a voltage variation of the external variable voltage source.

5. The light-emitting device according to claim 4, wherein when the light-emitting modules are the same and have the bypass units and the control unit, the light-emitting module nearer to the current output terminal is lighted up prior to the other light-emitting modules in the light-emitting modules during the rising of the external variable voltage source.

6. The light-emitting device according to claim 1, wherein the control unit controls the bypass unit according to a potential difference between the voltage of the detection terminal and at least one reference voltage.

7. The light-emitting device according to claim 6, wherein the reference voltage originates from a controller or the external variable voltage source.

8. The light-emitting device according to claim 6, wherein the control unit detects the potential difference between the voltage of the detection terminal and the reference voltage, the control unit controls the bypass unit to get short-circuited or partially short-circuited when an absolute value of the potential difference is lower than a predetermined value, and the control unit controls the bypass unit to get open-circuited or partially open-circuited when the absolute value of the potential difference is higher than the predetermined value.

9. The light-emitting device according to claim 6, wherein the control unit has at least one comparison circuit, the comparison circuit has two comparison input terminals and one comparison output terminal, the voltage of the detection terminal and the reference voltage are respectively inputted to the comparison input terminals, the comparison output terminal is electrically connected to the bypass unit, and the comparison circuit controls the bypass unit and adjusts the current flowing through the light-emitting unit.

10. The light-emitting device according to claim 1, wherein the bypass unit and the light-emitting unit are connected in parallel.

11. The light-emitting device according to claim 1, further comprising: a current source electrically connected to one of the light-emitting modules of the light-emitting modules.

12. The light-emitting device according to claim 1, wherein the light-emitting unit comprises at least one light-emitting diode.

13. The light-emitting device according to claim 1, wherein the bypass unit comprises a transistor switch.

14. The light-emitting device according to claim 13, wherein the transistor switch is a bipolar transistor (BJT) or a field effect transistor (FET).

15. The light-emitting device according to claim 1, wherein the voltage of the detection terminal is affected by a crossover voltage generated when the light-emitting unit of the other light-emitting module is bypassed or turned on.

16. The light-emitting device according to claim 1, wherein the voltage of the detection terminal is affected by crossover voltages of all the light-emitting modules between the detection terminal and a ground.

* * * * *